US009780536B2

(12) United States Patent
Niessner

(10) Patent No.: US 9,780,536 B2
(45) Date of Patent: Oct. 3, 2017

(54) SPARK PLUG WITH INTERFERENCE-SUPPRESSION ELEMENT

(71) Applicant: Federal-Mogul Ignition GmbH, Neuhaus-Schierschnitz (DE)

(72) Inventor: Werner Niessner, Steinheim (DE)

(73) Assignee: FEDERAL-MOGUL IGNITION GMBH, Neuhaus-Schierschnitz (DE)

( * ) Notice: Subject to any disclaimer, the term of this patent is extended or adjusted under 35 U.S.C. 154(b) by 26 days.

(21) Appl. No.: 14/821,417

(22) Filed: Aug. 7, 2015

(65) Prior Publication Data

US 2016/0064904 A1 Mar. 3, 2016

(30) Foreign Application Priority Data

Aug. 26, 2014 (DE) ..... 10 2014 112 225

(51) Int. Cl.

| | |
|---|---|
| ***H01T 13/41*** | (2006.01) |
| *H01T 13/08* | (2006.01) |
| *H01T 13/05* | (2006.01) |
| *H01T 13/20* | (2006.01) |

(52) U.S. Cl.

CPC ..... *H01T 13/41* (2013.01); *H01T 13/05* (2013.01); *H01T 13/08* (2013.01); *H01T 13/20* (2013.01)

(58) Field of Classification Search

CPC ..... H01T 13/41; H01T 13/20; H01T 13/05; H01T 13/08

See application file for complete search history.

(56) References Cited

U.S. PATENT DOCUMENTS

| | | | | |
|---|---|---|---|---|
| 3,292,072 | A | 12/1966 | Hyltén-Cavallius et al. | |
| 4,224,554 | A * | 9/1980 | Nishio | H01T 13/41 123/633 |
| 4,625,085 | A * | 11/1986 | Yoshida | C04B 35/453 200/19.4 |
| 5,565,730 | A * | 10/1996 | Pollner | H01T 13/41 313/135 |
| 8,355,623 | B2 | 1/2013 | Vinegar et al. | |

FOREIGN PATENT DOCUMENTS

| | | |
|---|---|---|
| DE | 1013924 B | 8/1957 |
| DE | 1763207 U | 3/1958 |
| DE | 3905315 A1 | 8/1990 |
| DE | 602005006115 T2 | 5/2009 |

OTHER PUBLICATIONS

German Search Report dated May 12, 2015, 8 pages.

* cited by examiner

*Primary Examiner* — Donald Raleigh
*Assistant Examiner* — Kevin Quarterman
(74) *Attorney, Agent, or Firm* — Reising Ethington, P.C.

(57) ABSTRACT

A spark plug having a spark plug body and an insulator arranged therein, in which insulator a passage is provided in which a center electrode, an ignitor and a glass seal connecting the center electrode to the ignitor and acting as an interference-suppression resistor are arranged. At least one additional interference-suppression element is arranged in the passage of the insulator.

10 Claims, 2 Drawing Sheets

SPARK PLUG WITH INTERFERENCE-SUPPRESSION ELEMENT

This application claims the benefit of German Application No. 10 2014 112 225.9, filed on Aug. 26, 2014, the contents of which are hereby incorporated by reference in their entirety.

FIELD

This invention generally relates to spark plugs and other ignition devices for internal combustion engines and, in particular, to interference-suppression elements therein.

BACKGROUND

Spark plugs have been successfully used for decades in gasoline engines. Such a spark plug is described in DE 39 05 315 A1, in which a glass composition for a glass seal is described which forms an interference-suppression resistor and is temperature- and voltage-stable over a long period of time.

The glass seal as an ohmic interference-suppression resistor has produced good results over the decades and has met the requirements for electromagnetic compatibility (EMC) of motor vehicles. Increasing use of carbon fiber reinforced plastics in body construction, as a replacement for sheet metal parts, and the presence of more electronic devices in the vehicle can result in higher EMC requirements, which may not be fulfilled by the known spark plugs.

SUMMARY

It is an object of the present application to reduce the electromagnetic interference behavior of the present spark plug.

The present spark plug has a spark plug body including an insulator arranged therein. The insulator is composed of a ceramic material. The insulator is sleeve-shaped and has an elongated shape. The spark plug body surrounds the insulator and has a ground electrode at the front end of the spark plug. At the rear end of the spark plug, the insulator protrudes out of the spark plug body. Inside the insulator, a passage is provided in which a center electrode, an ignitor and a glass seal connecting the center electrode to the ignitor are arranged. At the front end of the spark plug, the center electrode protrudes out of the insulator and, together with the ground electrode, forms an air spark route there. At the rear end of the spark plug, the ignitor protrudes out of the insulator and serves there for connecting a line for supplying voltage to the spark plug. The glass seal fixedly connects the ignitor in an electrically conductive manner to the center electrode and forms an ohmic resistor between the ignitor and the center electrode, which acts as an interference-suppression resistor. The glass seal seals the passage of the insulator in a gas-tight manner so that no gases can escape from the combustion chamber of the internal combustion engine through the passage of the insulator. At least one additional interference-suppression element is arranged in the passage of the insulator, which additional interference-suppression element particularly is composed of a ferromagnetic material. Particularly, the additional interference-suppression element may be formed annularly and surrounds a portion of the ignitor, the center electrode and/or the glass seal.

The electromagnetic interference behavior of the present spark plug can be reduced by the at least one additional interference-suppression element. The spark plug meets higher EMC requirements.

Due to the fact that the additional interference-suppression element is arranged in the passage of the insulator, the present spark plug can be produced in a very simple manner using the known manufacturing technology. Producing the spark plug according to the techniques described herein causes hardly any additional effort.

The additional interference-suppression element in the present spark plug attenuates the interference pulses very close to the point of origin and therefore is very effective.

The spark plug is basically a tubular capacitor having a ceramic insulator as a dielectric. In addition, however, there are air gaps in the spark plug at which internal corona discharges can occur. Internal corona discharges also cause interference signals which propagate outwards from the spark plug. The additional interference-suppression element, in particular if it annularly surrounds a portion of the ignitor, is also very capable of attenuating interference signals resulting from corona discharges.

Annular interference-suppression elements made of ferromagnetic material can greatly attenuate or even completely suppress undesirable interference pulses.

In a preferred configuration, the additional interference-suppression element is composed of a ferrite having a Curie temperature of more than 250° C. This temperature stability is advantageous since during operation, the spark plug is exposed to a temperature load caused by combustion heat, and it should be ensured that the additional interference-suppression element does not lose is ferromagnetic properties during operation. During operation, temperatures up to 250° C. can be reached in the spark plug body. Surprisingly, however, it is not required that the Curie temperature of the material of the additional interference-suppression element lies above the temperature to which the insulator is heated during the production of the glass seal. When melting glass, temperatures of 900° C. can be reached, for example. Even if the additional interference-suppression element becomes non-magnetic at these temperatures, it restores its magnetic properties after cooling. For high-temperature applications in high-performance engines it is advantageous if the additional interference-suppression element is composed of a ferrite having a Curie temperature of more than 500° C. since spark plugs of this kind can reach very high temperatures during operation. Particularly advantageous are nickel-zinc ferrites which, due to their high Curie temperatures, can effect particularly good attenuation of interference pulses for the temperatures occurring at spark plugs, wherein the effect lasts over a long period of time.

It can be advantageous if a plurality of annular interference-suppression elements are arranged one behind the other in the longitudinal direction in the passage of the insulator. Preferably, the ignitor can have a shoulder against which the additional interference-suppression rests. As a result, the annular interference-suppression element can be attached in a very simple manner onto the ignitor and is positioned by the shoulder of the ignitor when mounting the ignitor. This allows simple mounting of the additional interference-suppression element.

In another configuration, the passage in the insulator can be configured as a stepped hole. The additional interference-suppression element can preferably rest against the step of the stepped hole. This likewise simplifies mounting of the spark plug. It is particularly advantageous if the at least one additional interference-suppression element is positioned between the shoulder of the ignitor and the step of the stepped hole. The axial position of the at least one additional interference-suppression element in the passage of the insulator is determined by the step of the stepped hole and the shoulder of the ignitor so that no further positioning measures are required.

DRAWINGS

Further advantages and features may arise from the following description of some exemplary embodiments in connection with the figures. In the figures.

DESCRIPTION

Figure 1:
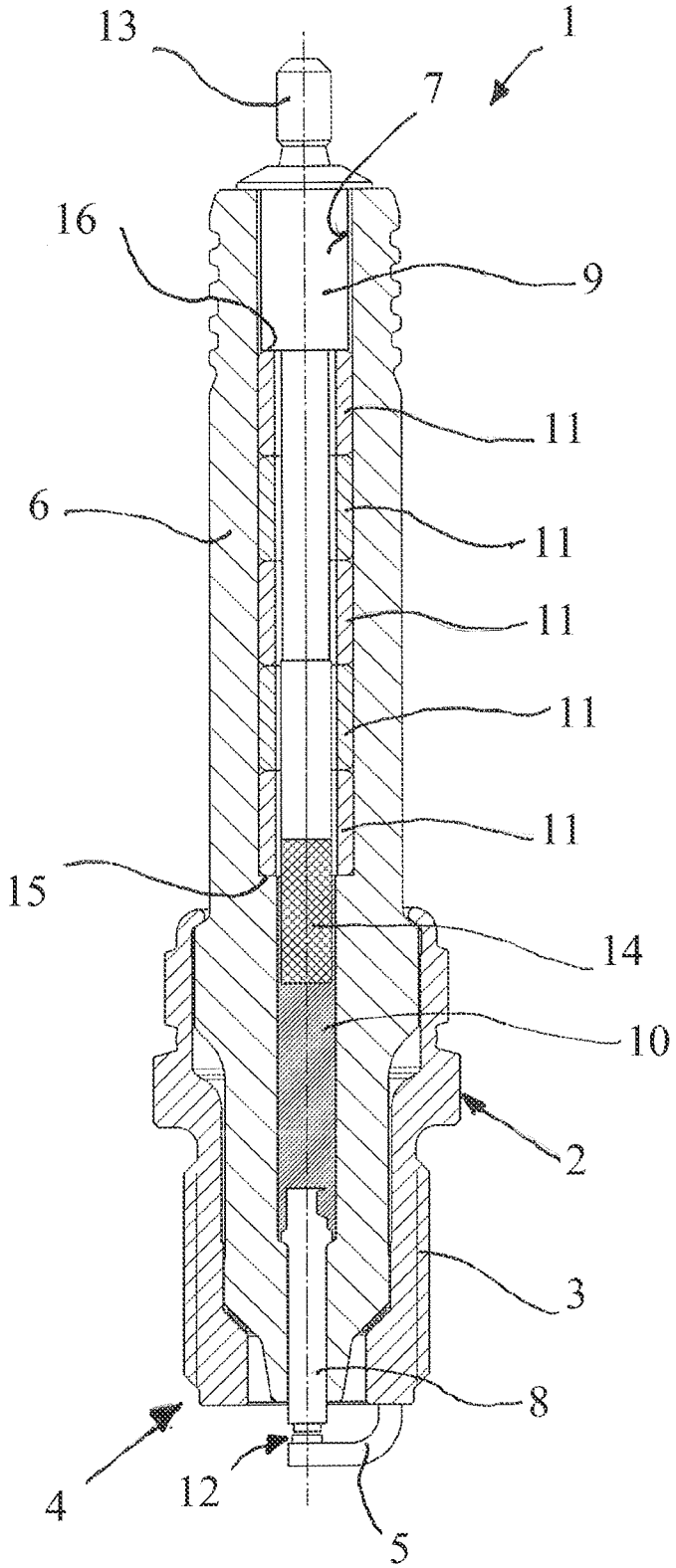
FIG. 1 shows a spark plug in longitudinal section.

The spark plug 1 illustrated in FIG. 1 includes a sleeve-shaped spark plug body or shell 2 having an external thread 3 for screwing into a combustion chamber. At the front end 4 of the spark plug 1, a ground electrode 5 is fastened to the front side of the spark plug body 2. The spark plug body 2 accommodates an elongated sleeve-shaped insulator 6 in which a passage 7 is provided. The insulator 6 protrudes with its rear end out of the spark plug body 2. A center electrode 8, an ignitor 9, a glass seal 10 and at least one additional interference-suppression element 11 are arranged in the passage 7.

At the front end 4, the center electrode 8 protrudes out of the insulator 6 and the front side of the center electrode, together with the ground electrode 5, forms an air gap route or spark gap 12. In the region of the air gap route 12, the ground electrode 5 and/or the center electrode 8 can be protected against wear by a small precious metal plate. The ignitor 9 protrudes with its connector 13 out of the rear end of the insulator 6. There, a non-illustrated ignition cable can be connected for supplying ignition voltage to the spark plug. At its end facing towards the center electrode 8, the ignitor 9 has a knurling 14. The center electrode 8 and the ignitor 9 are fixedly connected by the glass seal 10. The glass seal 10 is composed of a composite glass, for example a glass-graphite composite, and is electrically conductive. As a result, the glass seal 10 forms an ohmic interference-suppression resistor. Moreover, the glass seal 10 seals the passage 7 of the insulator 6 in a gas-tight manner so that no combustion gases can escape from the combustion chamber of the internal combustion engine through the passage 7.

The passage 7 in the insulator 6 is formed as a stepped hole having a step 15. The ignitor 9 has a shoulder 16 that faces away from the ignitor's connector 13. In FIG. 1, five annular interference-suppression elements 11 are illustrated which are made of ferrite and surround a portion of the ignitor 9. The interference elements 11 are positioned by the step 15 and the shoulder 16 in the longitudinal direction of the spark plug. The number and length of the interference-suppression elements 11 is variable; it is also possible that the spark plug 1 has only one interference-suppression element 11, for example.

During the production of the spark plug 1, the center electrode 8, glass powder for the glass seal 10, the interference-suppression elements 11 and the ignitor 9 are mounted in the insulator 6. Subsequently, the insulator is heated to approximately 900° C. so that the glass of the glass seal 10 melts. Subsequently, the insulator 6 is cooled again. After cooling, the center electrode 8 and the ignitor 9 are fixedly connected by the glass seal 10.

Figure 2:
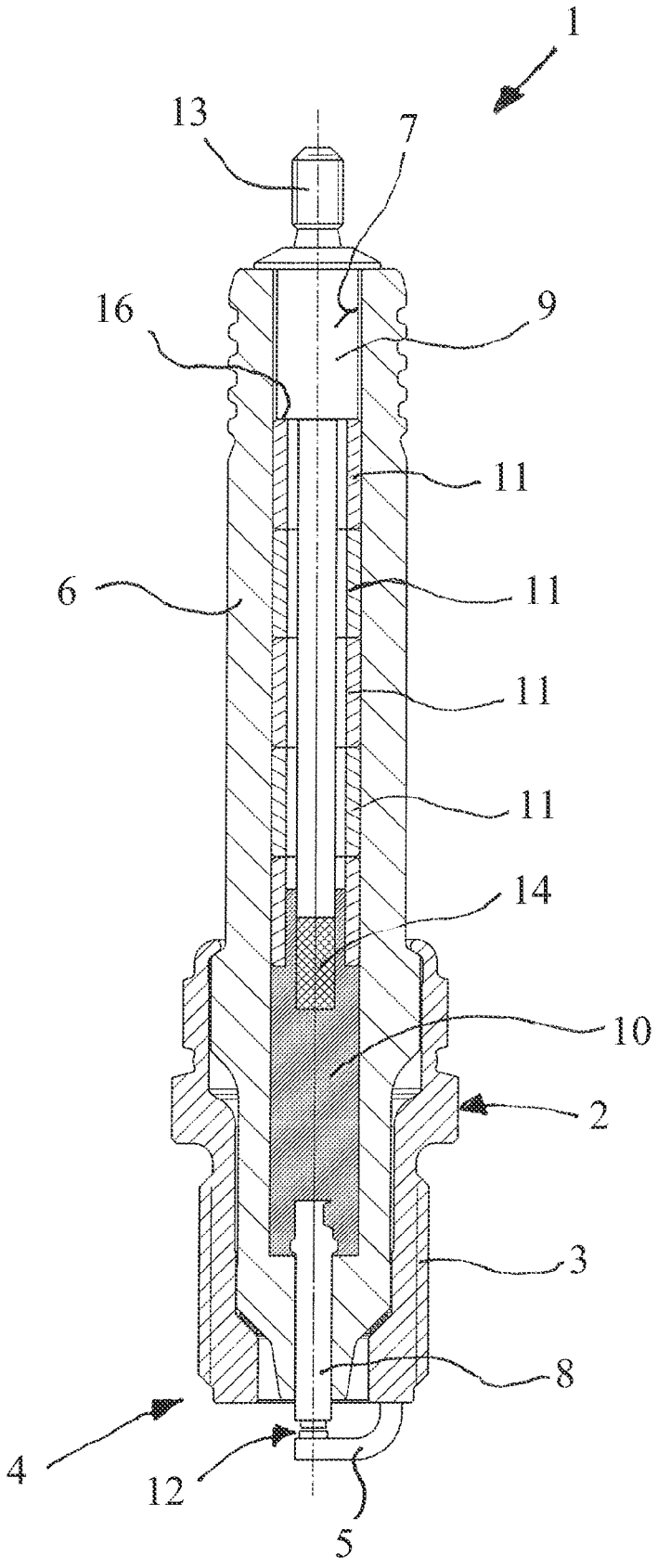
FIG. 2 shows a view similar to FIG. 1 of a variant of a spark plug.

FIG. 2 illustrates a variant of a spark plug 1 in which the interference-suppression elements 11 do not rest against a step 15 in the insulator 6. Apart from this, the spark plug of FIG. 2 corresponds to the spark plug in FIG. 1 so that reference can be made to the description above to avoid repetitions.

REFERENCE LIST

1 spark plug
2 spark plug body
3 external thread
4 front end
5 ground electrode
6 insulator
7 passage
8 center electrode
9 ignitor
10 glass seal
11 additional interference-suppression element
12 air gap route
13 connector
14 knurling
15 step
16 shoulder

The invention claimed is:

1. A spark plug having a spark plug body and an insulator arranged therein, the insulator includes a passage in which a center electrode, an ignitor having a shoulder and an end facing the center electrode, and a glass seal connecting the center electrode to the ignitor and acting as an interference-suppression resistor are arranged, wherein a plurality of additional interference-suppression elements are arranged in the passage of the insulator, surround a portion of the ignitor, and at least one of the plurality of additional interference-suppression elements contacts the shoulder of the ignitor, wherein each additional interference-suppression element of the plurality of additional interference-suppression elements are located between the shoulder of the ignitor and the end of the ignitor facing the center electrode.

2. The spark plug according to claim 1, wherein at least one additional interference-suppression element is composed of a ferromagnetic material.

3. The spark plug according to claim 1, wherein at least one additional interference-suppression element is formed annularly and surrounds a portion of the center electrode and/or the glass seal.

4. The spark plug according to claim 3, wherein the plurality of additional interference-suppression elements are annular and are arranged one behind the other in the passage of the insulator in the longitudinal direction of the spark plug.

5. The spark plug according to claim 1, wherein the passage in the insulator is configured as a stepped hole.

6. The spark plug according to claim 5, wherein at least one additional interference-suppression element rests against a step of the stepped hole.

7. The spark plug according to claim 1, wherein at least one additional interference-suppression element is composed of a ferrite having a Curie temperature of more than 250° C.

8. The spark plug according to claim 1, wherein at least one additional interference-suppression element is composed of a nickel-zinc ferrite.

9. The spark plug according to claim 1, wherein at least one additional interference-suppression element is composed of a ferrite having a Curie temperature of more than 500° C.

10. A spark plug having a spark plug body and an insulator arranged therein, the insulator includes a passage in which a center electrode, an ignitor having a shoulder, and a glass seal connecting the center electrode to the ignitor and acting as an interference-suppression resistor are arranged, wherein at least one additional interference-suppression element is arranged in the passage of the insulator, surrounds a portion of the ignitor, and contacts the shoulder of the ignitor, wherein the passage in the insulator is configured as a stepped hole and at least one additional interference-suppression element rests directly against a step of the stepped hole.

* * * * *